US006509689B1

(12) United States Patent
Kim et al.

(10) Patent No.: US 6,509,689 B1
(45) Date of Patent: Jan. 21, 2003

(54) PLASMA DISPLAY PANEL HAVING TRENCH TYPE DISCHARGE SPACE AND METHOD OF FABRICATING THE SAME

(75) Inventors: Steven Kim, Harrington Park, NJ (US); Erich E. Kunhardt, Hoboken, NJ (US); Seok-Kyun Song, Ridgefield, NJ (US); Bhum-Jae Shin, Jersey City, NJ (US); Sooho Park, Rutherford, NJ (US)

(73) Assignees: Plasmion Displays, LLC, Roanoke, VA (US); The Trustees of Stevens Institute of Technology, Hoboken, NJ (US)

( * ) Notice: Subject to any disclaimer, the term of this patent is extended or adjusted under 35 U.S.C. 154(b) by 138 days.

(21) Appl. No.: 09/691,254

(22) Filed: Oct. 19, 2000

Related U.S. Application Data

(60) Provisional application No. 60/205,565, filed on May 22, 2000.

(51) Int. Cl.[7] ..... H01J 17/49

(52) U.S. Cl. ..... 313/586; 313/584; 313/585; 313/587

(58) Field of Search ..... 313/584, 585, 313/586, 587, 493

(56) References Cited

U.S. PATENT DOCUMENTS

| | | | | |
|---|---|---|---|---|
| 3,983,445 A | | 9/1976 | Yasuda et al. | |
| 4,005,402 A | | 1/1977 | Amano | |
| 4,164,678 A | | 8/1979 | Biazzo et al. | |
| 4,224,553 A | * | 9/1980 | Hellwig | 313/489 |
| 4,728,864 A | | 3/1988 | Dick | |
| 5,674,553 A | | 10/1997 | Shinoda et al. | |
| 5,818,168 A | | 10/1998 | Ushifusa et al. | |
| 6,255,777 B1 | * | 7/2001 | Kim et al. | 313/582 |
| 6,262,532 B1 | * | 7/2001 | Park et al. | 313/585 |

* cited by examiner

*Primary Examiner*—Robert H. Kim
*Assistant Examiner*—Elizabeth Gemmell
(74) *Attorney, Agent, or Firm*—Morgan, Lewis & Bockius LLP

(57) ABSTRACT

The present invention discloses a plasma display panel and a method of fabricating the same. The plasma display panel of the present invention includes a first electrode on the first substrate, a first dielectric layer on the first substrate including the first electrode, a plurality of second electrodes completely buried in the first dielectric layer, a second dielectric layer on the first dielectric layer including the first electrode, a third dielectric layer on the second substrate, a plurality of UV visible photon conversion layers on the third dielectric layer, a plurality of barrier ribs between each of the UV visible photon conversion layers and connecting the first and second substrates, and a discharge chamber between the first and second substrates defined by the barrier ribs, wherein the first dielectric layer includes at least one trench type discharge space exposing a portion of the first electrode to the discharge chamber.

42 Claims, 17 Drawing Sheets

PLASMA DISPLAY PANEL HAVING TRENCH TYPE DISCHARGE SPACE AND METHOD OF FABRICATING THE SAME

This application claims the benefit of a provisional application, entitled "Plasma Display Panel Device Having Trench Discharge Space and Method of Fabricating the Same," which was filed May 22, 2000, and assigned Provisional Application No. 60/205,565, which is hereby incorporated by reference.

BACKGROUND OF THE INVENTION

1. Field of the Invention

The present invention relates to a plasma display panel, and more particularly, to a plasma display panel having a trench type discharge space and a method of fabricating the same. Although the present invention is suitable for a wide scope of applications, it is particularly suitable for the plasma display panel for generating a high density UV emission.

2. Discussion of the Related Art

A plasma display panel (PDP) utilizes gas discharges to convert electric energy into light. Each pixel in the PDP corresponds to a single gas-discharge site and the light emitted by each pixel is electronically controlled by video signals that represent images.

A unique advantage of PDP is that it combines a large screen size with a very thin display panel. Generally, PDP is the choice for large size display devices, typically larger than 40" diagonal.

A DC driven PDP has advantages of a highly controlled brightness and a fast response time while a device structure is often complicated. In addition, the DC driven PDP should include resistors. Thus, it is inevitable that a power consumption of the device is increased by the current limiting resistors.

An AC driven PDP in general has a simpler structure and higher reliability than those of the DC driven PDP. Most of the conventional AC driven PDP employs an AC barrier type discharge as disclosed in U.S. Pat. No. 5,674,553.

As shown in FIG. 10 of the present application, a conventional AC driven PDP includes a front glass substrate 111 on the side of the display surface H, a pair of display electrodes X and Y, a dielectric layer 117, a protecting layer 118 formed of MgO, a substrate 121 on the background side, a plurality of barriers 129 extending vertically and defining the discharge spaces 130 by contacting the protecting layer 118, address electrodes 122 disposed between the barriers 129, and phosphor layers 128R, 128G, and 128B.

Nonetheless, the conventional AC driven PDP has problems yet to be solved. For example, since the conventional AC driven PDP generates low density plasma, generated visible light has low brightness. Also, it has a slow response time due to a charging time on the dielectric wall, resulting in a gray scale problem.

SUMMARY OF THE INVENTION

Accordingly, the present invention is directed to a plasma display panel having a trench type discharge space and a method of fabricating the same that substantially obviate one or more of the problems due to limitations and disadvantages of the related art.

An objective of the present invention is to provide an improved plasma display panel device in brightness and response time.

Another object of the present invention is to provide both transmissive and reflective type plasma display panel devices.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a plasma display panel includes a first electrode on the first substrate, a first dielectric layer on the first substrate including the first electrode, a plurality of second electrodes completely buried in the first dielectric layer, a second dielectric layer on the first dielectric layer including the first electrode, a third dielectric layer on the second substrate, a plurality of UV visible photon conversion layers on the third dielectric layer, a plurality of barrier ribs between the UV visible photon conversion layers and connecting the first and second substrates, and a discharge chamber between the first and second substrates defined by the barrier ribs, wherein the first dielectric layer includes at least one trench type discharge space exposing a portion of the first electrode to the discharge chamber.

In another aspect of the present invention, a plasma display panel includes a plurality of UV visible photon conversion layers on the first substrate, a plurality of barrier ribs between the UV visible photon conversion layers, a first electrode on the second substrate, a first dielectric layer on the second substrate including the first electrode, a plurality of second electrodes completely buried in the first dielectric layer, a second dielectric layer on the first dielectric layer, and a discharge chamber between the first and second substrates defined by the barrier ribs connecting the first and second substrates, wherein the first dielectric layer has at least one trench type discharge space exposing a portion of the first electrode to the discharge chamber.

In another aspect of the present invention, a method of fabricating a plasma display panel having first and second substrates includes the steps of forming a first electrode on the first substrate, forming a first dielectric layer on the first substrate including the first electrode, forming a plurality of second electrodes in the first dielectric layer, the second electrodes being completely buried in the first dielectric layer, forming a second dielectric layer on the first dielectric layer including the second electrodes, forming a reflection layer on the second substrate, forming a UV visible photon conversion layer on the reflection layer, forming at least one trench type discharge space in the first and second dielectric layers exposing a portion of the first electrode in the trench type discharge space to the UV visible photon conversion layer, and forming a plurality of barrier ribs connecting the first and second substrates, thereby defining a discharge chamber between the first and second substrates.

In a further aspect of the present invention, a method of fabricating a plasma display panel having first and second substrates includes the steps of forming a UV visible photon conversion layer on the first substrate, forming a first electrode on the second substrate, forming a first dielectric layer on the second substrate including the first electrode, forming a plurality of second electrodes on the first dielectric layer, forming a second dielectric layer on the first dielectric layer including the second electrodes, forming at least on trench type discharge space in the first and second dielectric layers exposing a portion of the first electrode in the trench type discharge space to the UV visible conversion layer, and forming a plurality of barrier ribs connecting the first and second substrates, thereby defining a discharge chamber between the first and second substrates.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawing.

DETAILED DESCRIPTION OF THE PREFERRED EMBODIMENTS

Reference will now be made in detail to the preferred embodiments of the present invention, examples of which are illustrated in the accompanying drawing.

A reflective type plasma display panel according to the present invention will be described with reference to FIGS. 1 to 4. In these embodiments, for example, a substrate 1 (shown in FIG. 3A) on which a trench type discharge space 9 is formed becomes a front substrate. Thus, the substrate 1 acts as a viewing panel, as shown in FIG. 3A.

Figure 1A:
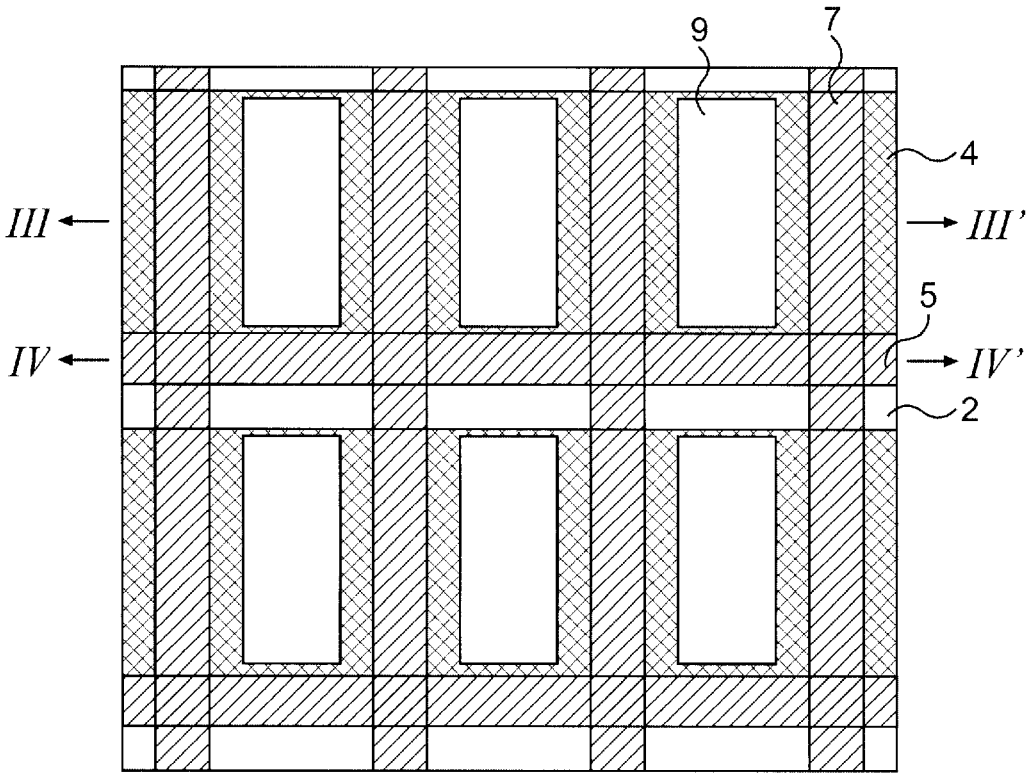
FIG. 1A is a top view of a front substrate of a plasma display panel according to a first embodiment of the present invention.
Figure 2:
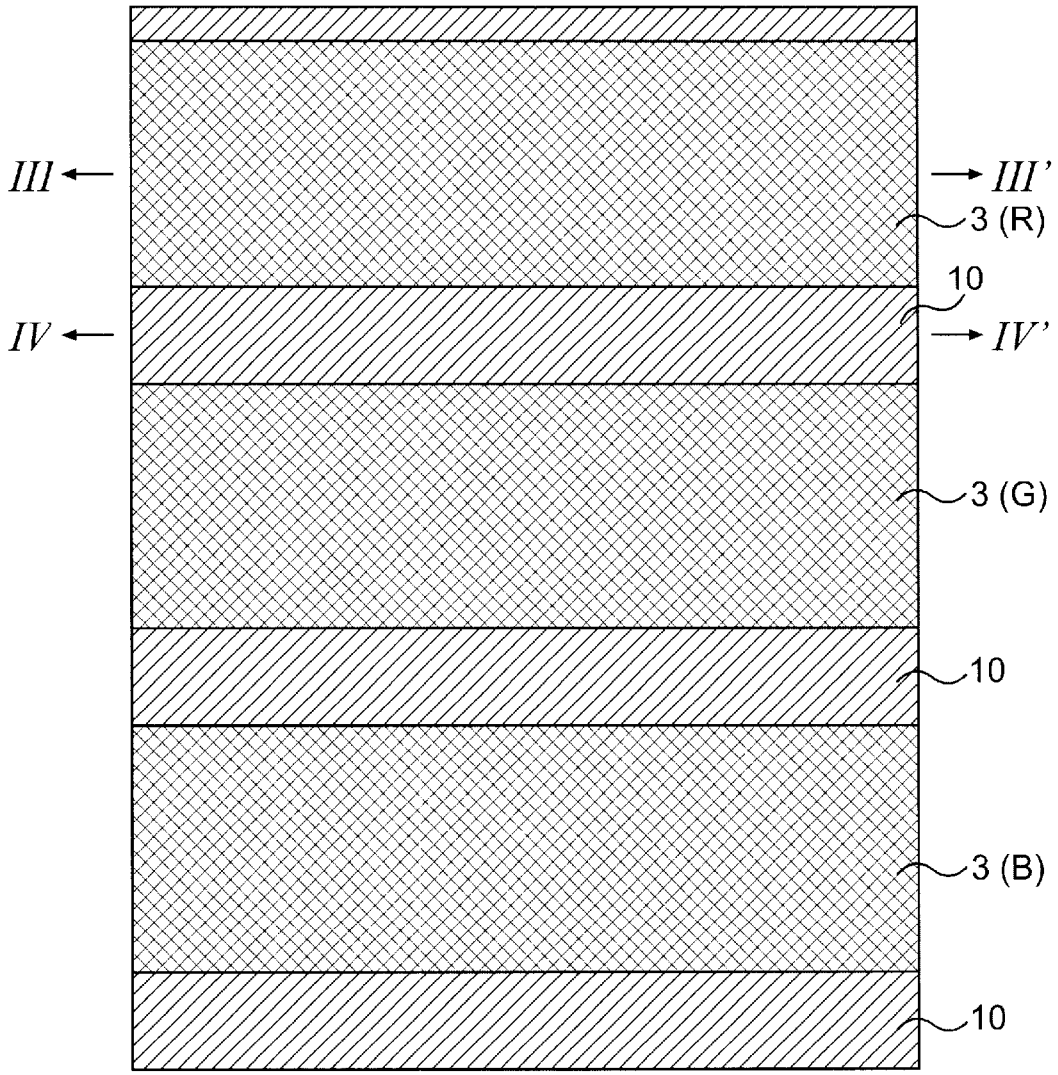
FIG. 2 is a top view of a rear substrate of the plasma display panel according to the present invention.

More specifically, FIGS. 1A and 2 respectfully illustrate top views of front and rear substrates of a PDP according to a first embodiment of the present invention. FIG. 3A is a combined cross-sectional view of the PDP according to the first embodiment of the present invention along with the line III–III' of FIGS. 1A and 2.

Figure 3A:
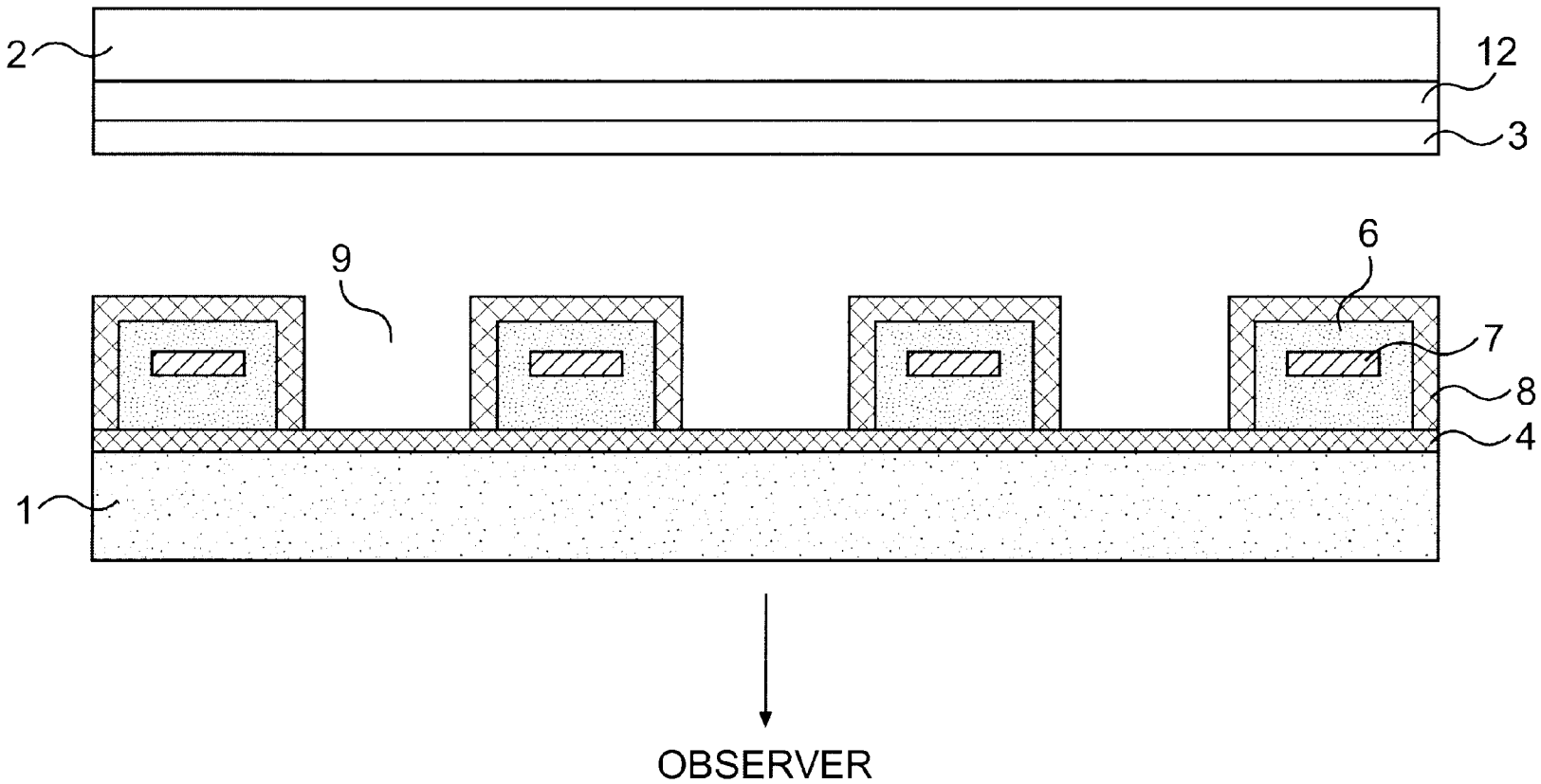
FIG. 3A is a combined cross-sectional view of the plasma display panel along with the line III–III' of FIGS. 1A and 2 according to the first embodiment of the present invention.

As shown in FIGS. 1A and 3A, a reflection layer 12 is formed on a rear substrate 2 to reflect the generated visible light (RGB) to the viewing panel. A front substrate 1 acts as a viewing panel in this embodiment. For example, the reflection layer 12 is formed of a white dielectric layer, thereby effectively reflecting the visible light (RGB) to the front substrate 1. A UV visible photon conversion layer 3 (for example, a phosphor layer) is formed on the reflection layer 12. A first electrode 4 acting as an address electrode, such as an ITO (indium tin oxide) layer, is formed on the front substrate 1. A first dielectric layer 6 is formed on the first electrode 4 including the front substrate 1. For example, lead oxide (PbO) glass may be used for the first dielectric layer 6 because PbO is transparent. A trench type discharge space 9 is formed in the first dielectric layer 6 to generate high plasma density in the present invention. The trench type discharge space 9 exposes a portion of the first electrode 4 to the UV visible photon conversion layer 3. Typically, the trench type discharge space 9 has a dimension of about 80 to 150 $\mu$m×240 $\mu$m. A plurality of second electrodes 7 are formed in the dielectric layer 6 as sustain electrodes. The sustain electrodes 7 are completely buried in the first dielectric layer 6. A second dielectric layer 8, such as a magnesium oxide (MgO) layer, is formed to protect the dielectric layer 6 from erosion by ion bombardments.

A plurality of barrier ribs 10 (shown in FIG. 2) on the UV visible photon conversion layer 3 connect the front substrate 1 and the rear substrate 2. A discharge chamber is defined by the pair of barrier ribs 10 between the front and rear substrates 1 and 2.

Figure 3B:
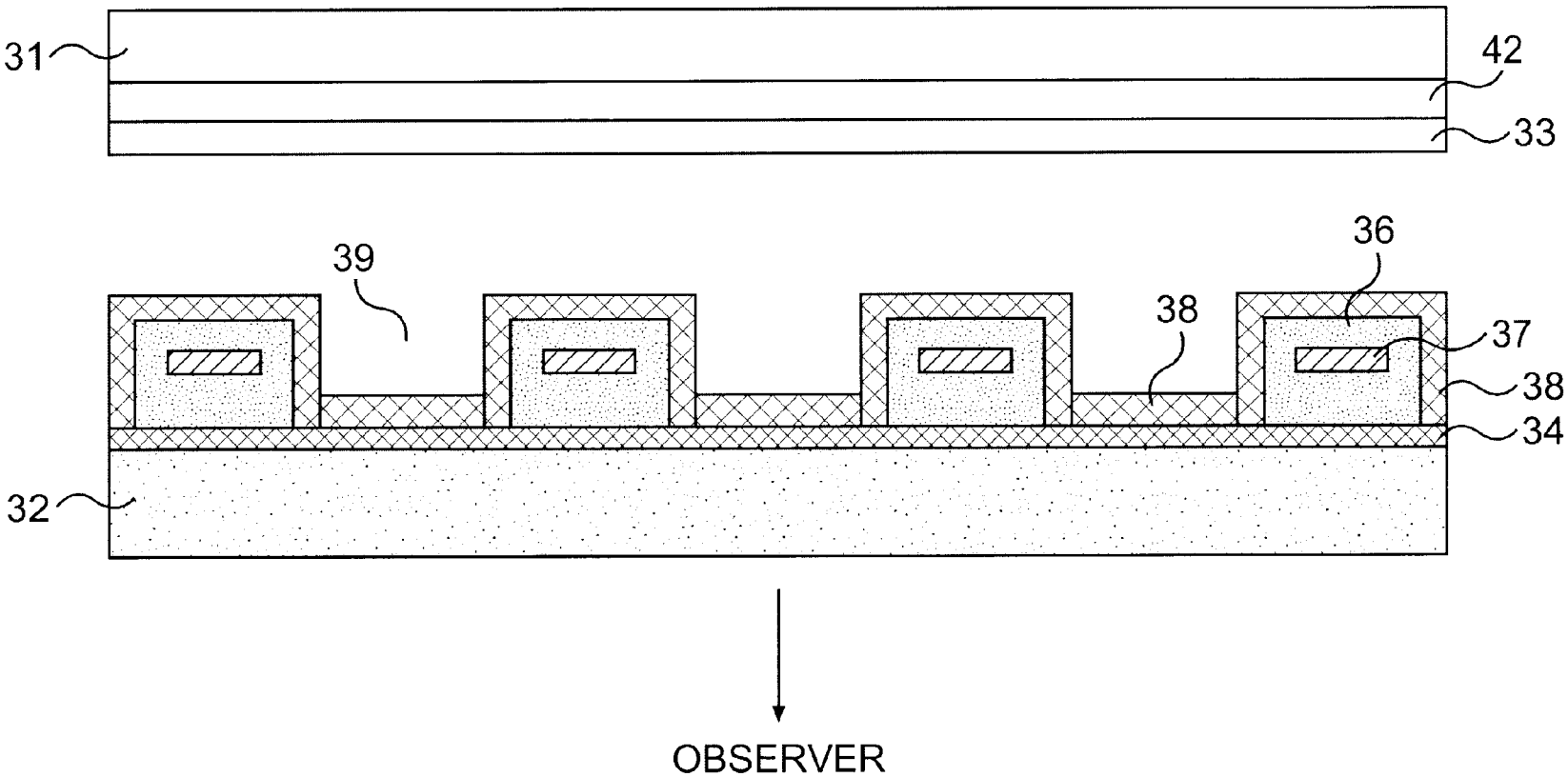
FIG. 3B is a combined cross-sectional view of the plasma display panel along with the line III–III' of FIGS. 1A and 2 according to a third embodiment of the present invention.

FIG. 3B is a combined cross-sectional view of the plasma display panel along with the line III–III' of FIGS. 1A and 2 according to a third embodiment of the present invention. In FIG. 3B, a PDP has a similar structure as that of the first embodiment shown in FIG. 3A, except for that a second dielectric layer 38, such as a magnesium oxide (MgO) layer, is formed on a portion of the first electrode 34 exposed by a trench discharge space 39 as well as on a first dielectric layer 36. The second dielectric layer 38 protects the exposed portion of the first electrode 34 by the trench type discharge spaces 39 including the dielectric layer 36 from an erosion by ion bombardments.

Figure 4:
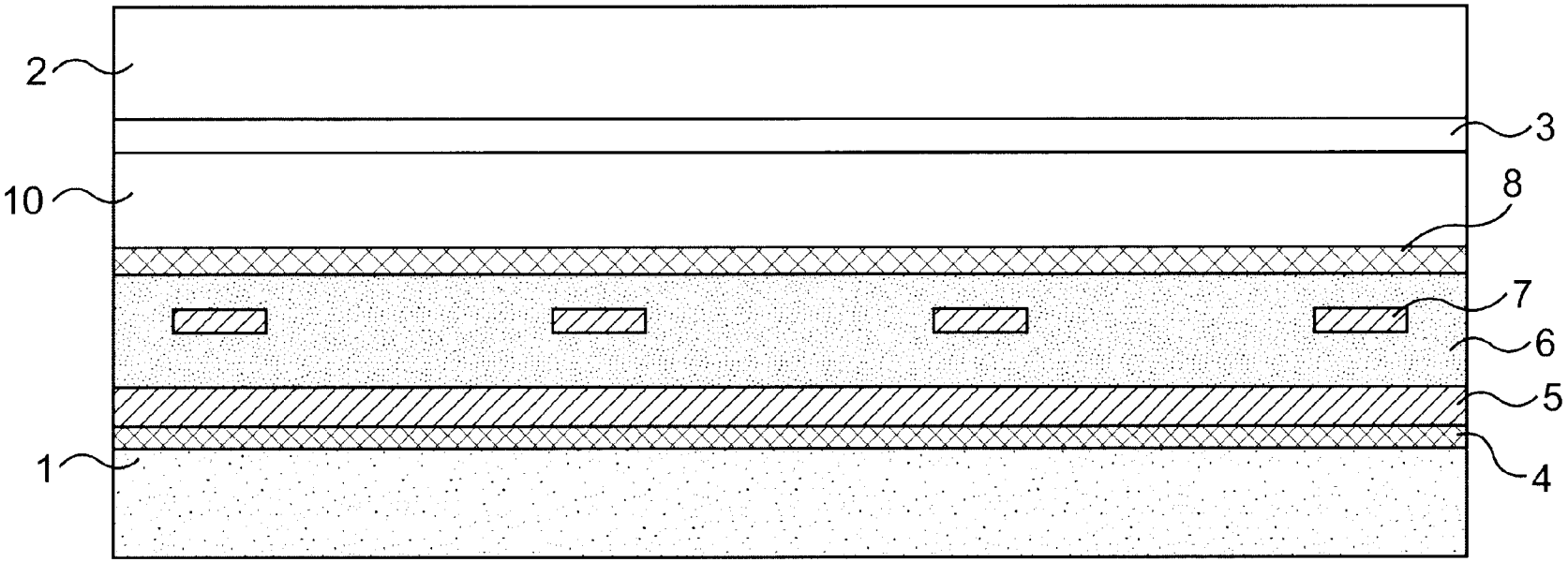
FIG. 4 is a combined cross-sectional view of the plasma display panel along with the line IV–IV'of FIGS. 1A and 2 according to the first embodiment of the present invention.

FIG. 4 illustrates a combined cross-sectional view of the PDP according to the first embodiment of the present invention along with the line IV–IV' of FIGS. 1A and 2. As shown in FIG. 4, a first electrode 4 acting as an address electrode is formed on a front substrate 1. A third electrode 5 (preferably, formed of silver) acts as a bus electrode, and is formed on the first electrode 4. A first dielectric layer 6 is further formed on the third electrode 5. A plurality of second electrodes 7 as sustain electrodes are formed in the first dielectric layer 6. A second dielectric layer 8, such as a magnesium oxide (MgO) layer, is further formed on the first dielectric layer 6 for protection from an erosion caused by ion bombardments. A barrier rib 10 is formed between a UV visible photon conversion layer 3 and the second dielectric layer 8. In this embodiment, the third electrode 5 is substantially parallel to the barrier ribs 10.

Figure 1B:
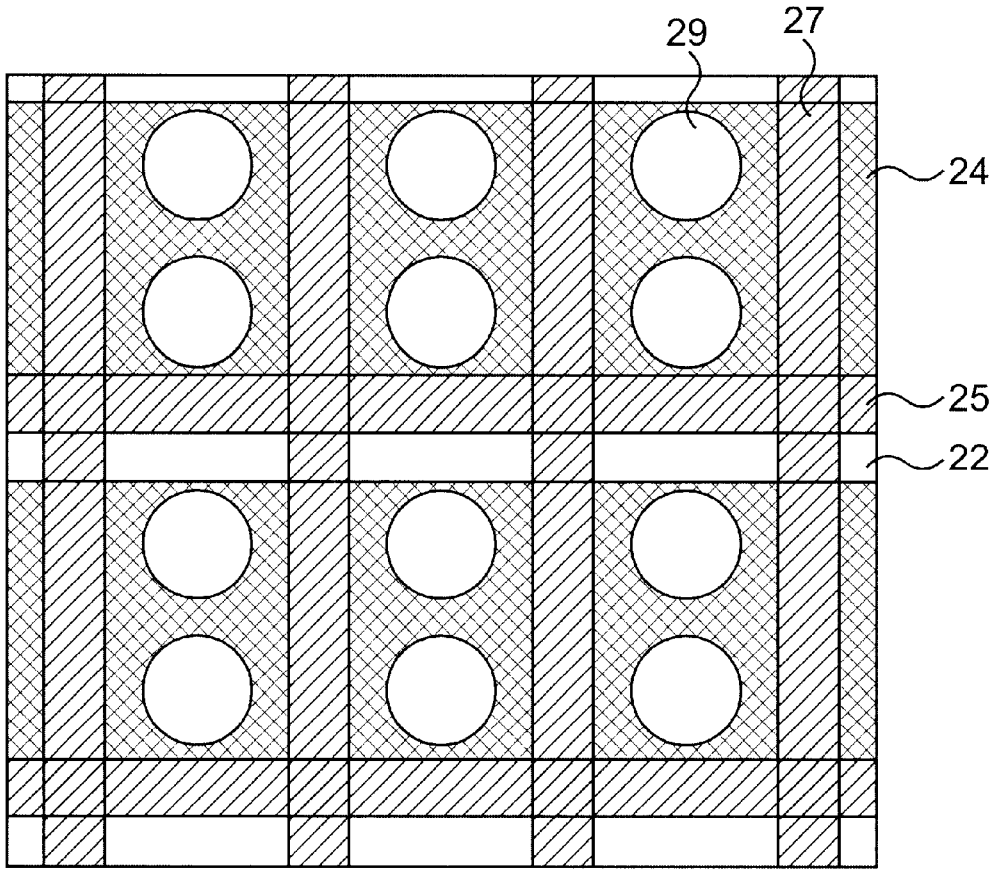
FIG. 1B is a top view of a front substrate of the plasma display panel according to a second embodiment of the present invention.
Figure 1C:
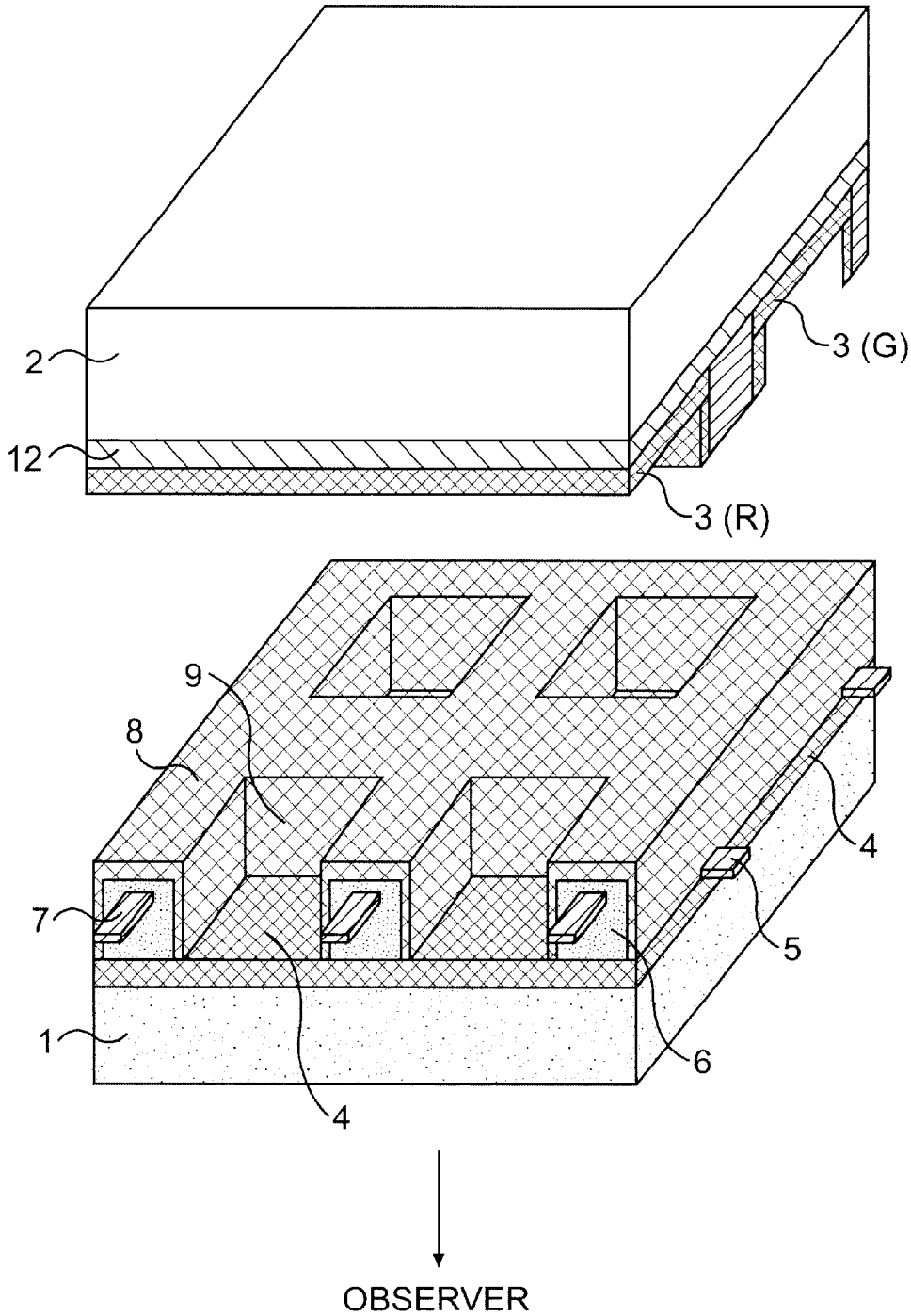
FIG. 1C is a combined perspective view of front and rear substrates of the plasma display panel according to the first embodiment of the present invention.

FIG. 1B illustrates a top view of the front substrate of the plasma display panel according to a second embodiment of the present invention. A PDP device of the second embodiment has a similar structure as that of the first embodiment, except for that the trench type discharge space has a cylindrical shape. In this embodiment, more than one cylindrical type discharge space may be formed in each pixel. Also, the cylindrical type discharge space has a diameter of 80 to 150 $\mu$m.

A structure of the rear substrate of the preferred embodiment of the present invention is schematically illustrated in FIG. 2. To convert UV to visible light, a UV visible photon conversion layer 3R, 3G, and 3B, such as a phosphor layer, for generating red, green, and blue is formed on the rear substrate. A barrier ribs 10 are formed between the UV visible photon conversion layer 3R, 3G, and 3B, as shown in FIG. 2.

A transmissive type plasma display panel according to the present invention will be described with reference to FIGS. 5 to 8. In these embodiments, substrates 51 and 71 on which a trench type discharge space is not formed act as viewing panels, as shown in FIGS. 7A, 7B, and 8.

Figure 5A:
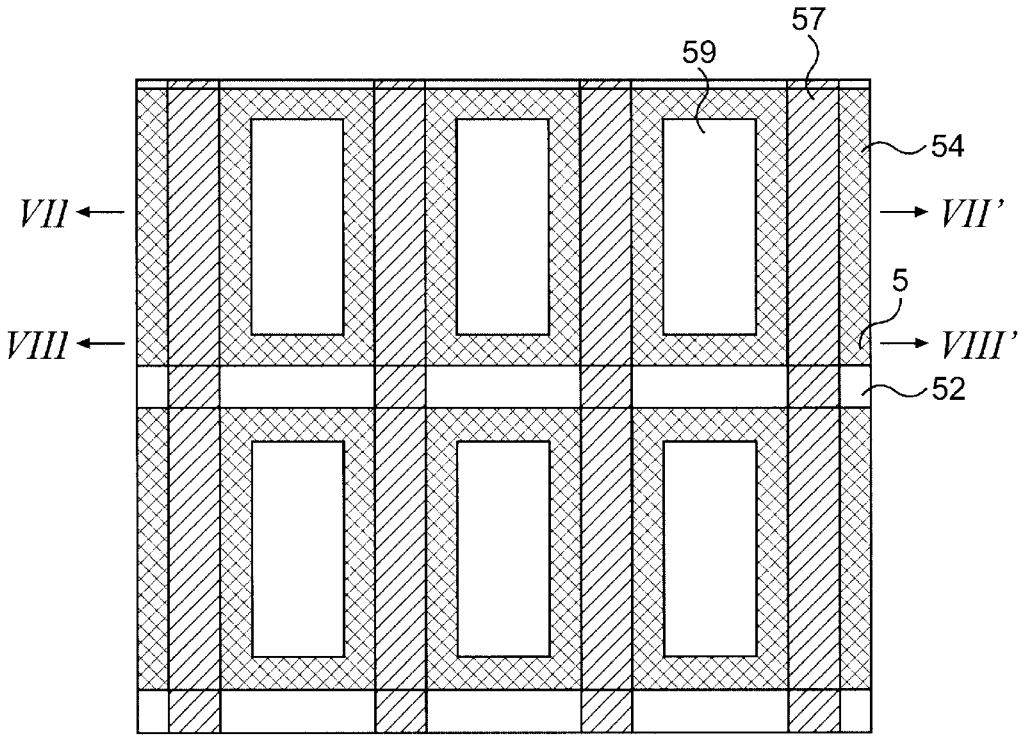
FIG. 5A is a top view of a rear substrate of the plasma display panel according to a fourth embodiment of the present invention.
Figure 6:
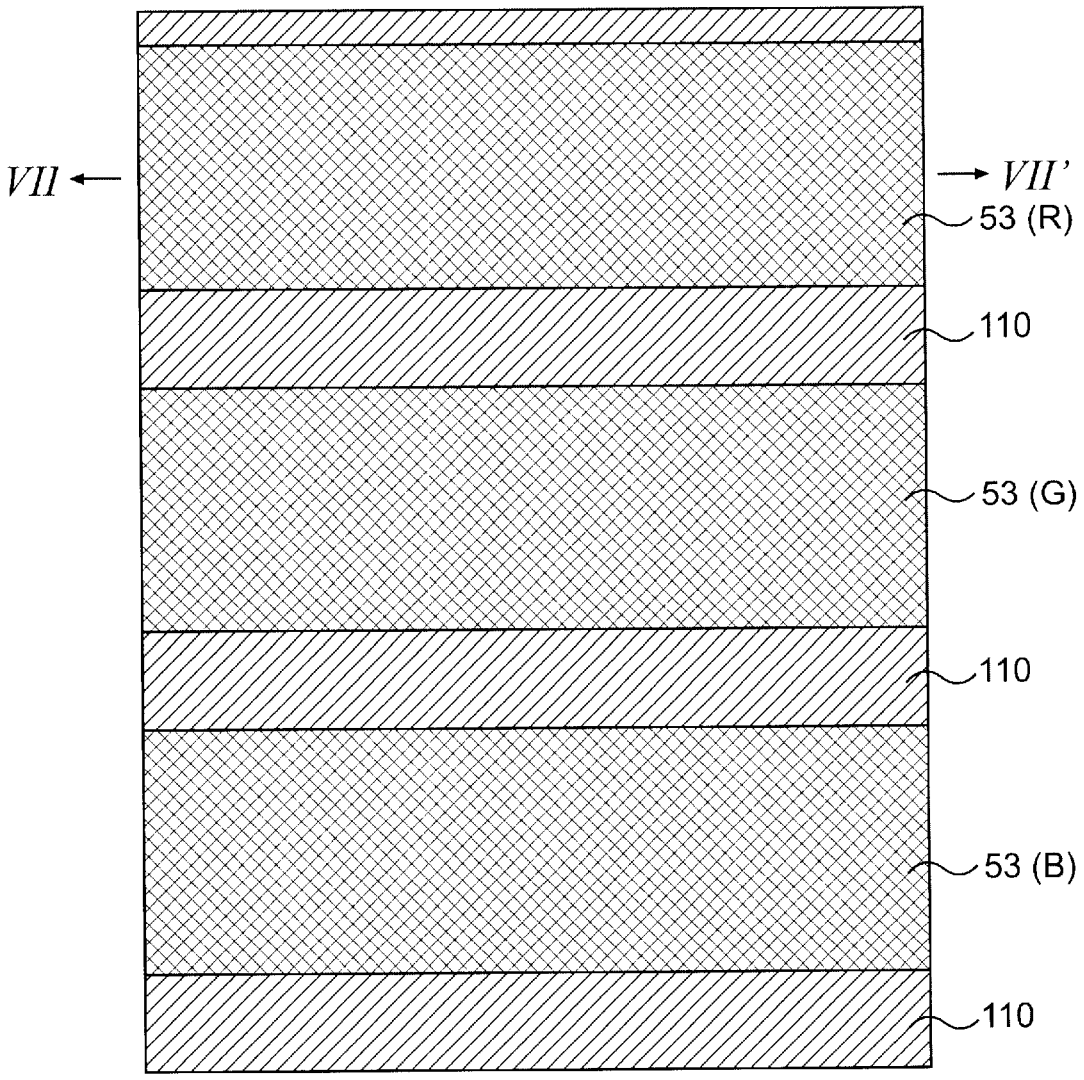
FIG. 6 is a top view of a front substrate of the plasma display panel according to the present invention.

FIGS. 5A and 6 respectively illustrate top views of rear and front substrates of the PDP according to a fourth embodiment of the present invention. FIG. 7A is a combined cross-sectional view of the PDP according to the fourth embodiment along with the line VII–VII' of FIGS. 5A and 6.

Figure 7A:
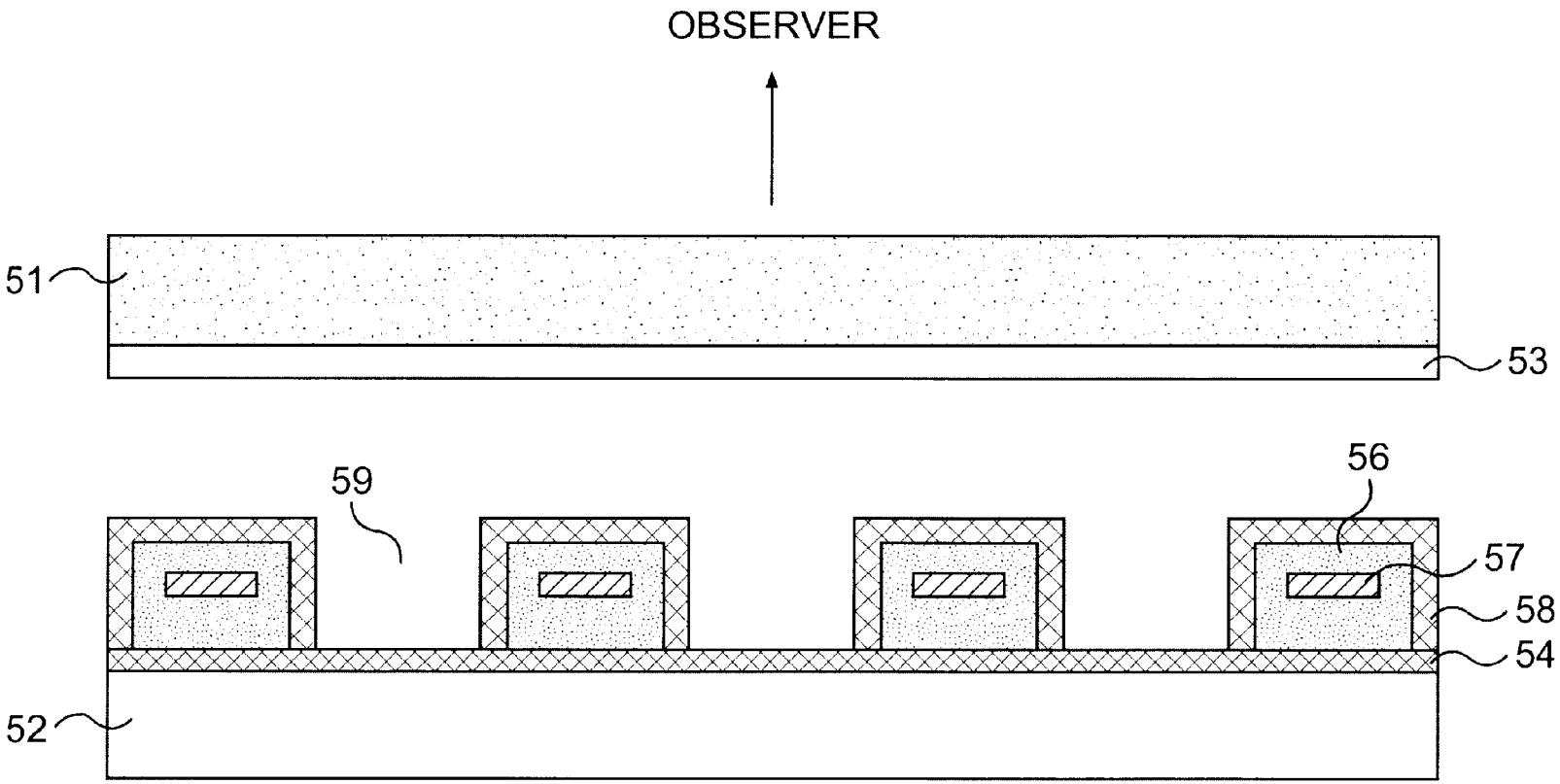
FIG. 7A is a cross-sectional view of the plasma display panel along with the line of VII–VII' of FIG. 5A according to the fourth embodiment of the present invention.
Figure 8:
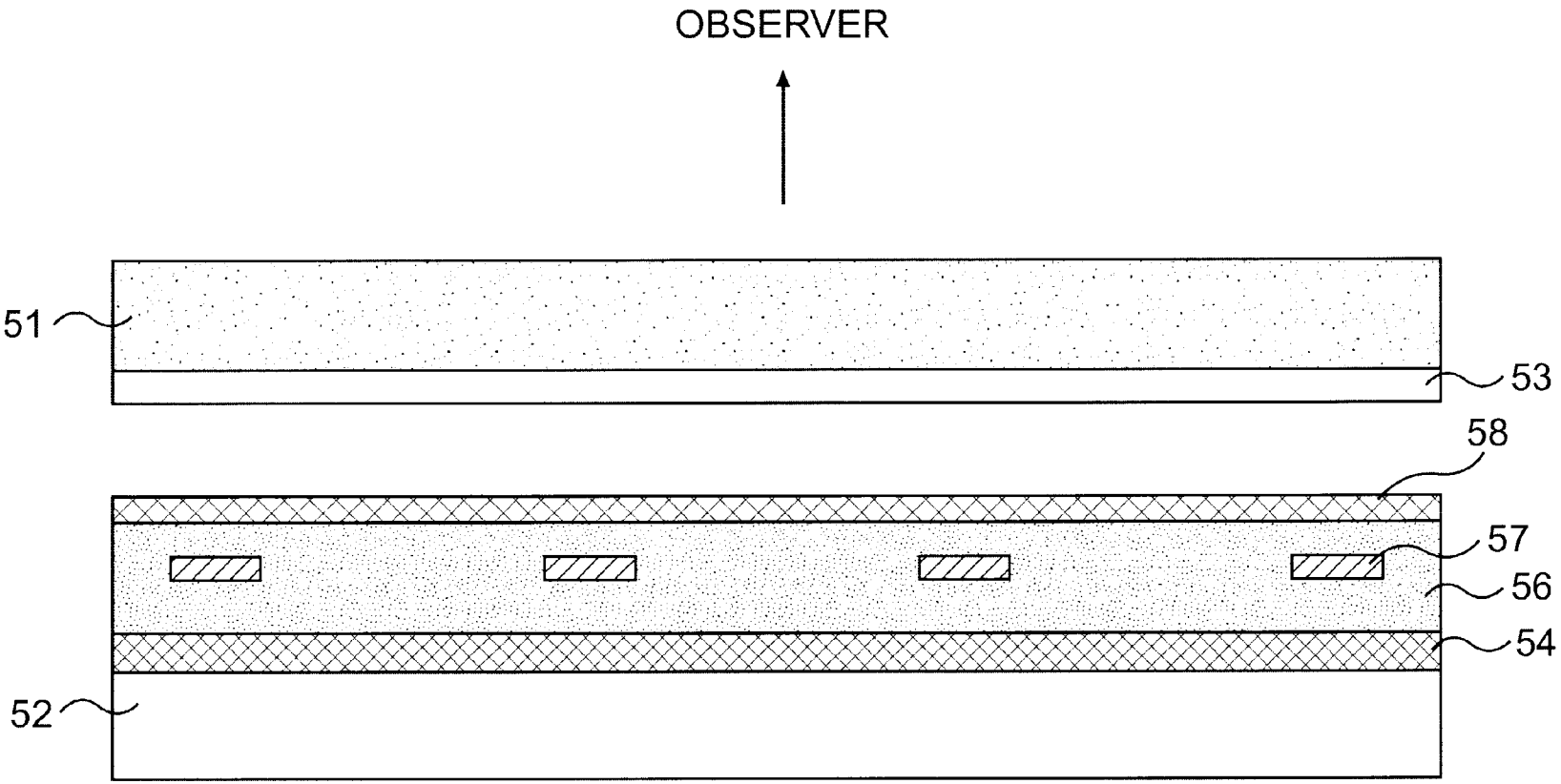
FIG. 8 is a cross-sectional view of the plasma display panel along with the line of VIII–VIII' of FIG. 5A according to the fourth embodiment of the present invention.

As shown in FIGS. 5A and 7A, a reflection layer 54, preferably formed of aluminum (Al), is formed on a rear substrate 52. The reflection layer 54 reflects the UV generated in a trench type discharge space 59 to the direction of the viewing panel, so that it increases efficiency of the PDP in generating visible light. For example, when the reflection layer 54 is formed of Al, it can reflect 92% of UV light at the 147 nm wavelength. A first dielectric layer 56 having the trench type discharge space 59 is formed on the reflection layer 54. A plurality of second electrodes 57 acting as sustain electrodes are completely buried in the first dielectric layer 56. A second dielectric layer 58, such as a magnesium oxide (MgO) layer 58, is formed to cover the entire surface of the first dielectric layer 56 for protection from an erosion by ion bombardments. On a front substrate 51 acting as a viewing panel, a UV visible photon conversion layer 53 is formed thereon. Preferably, a phosphor layer may be the choice of the UV visible photon conversion layer 53. A plurality of barrier ribs 110 (shown in FIG. 6) is formed between the UV visible photon conversion layer 53 and connect the front substrate 51 and the rear substrate 52. A trench type discharge space 59 is formed in the first dielectric layer 56, so that a portion of the reflection layer 54 is exposed to the UV visible photon conversion layer 53. In these embodiments, the trench type discharge space 59 has a dimension of about 80 to 150 $\mu$m×240 $\mu$m.

Figure 7B:
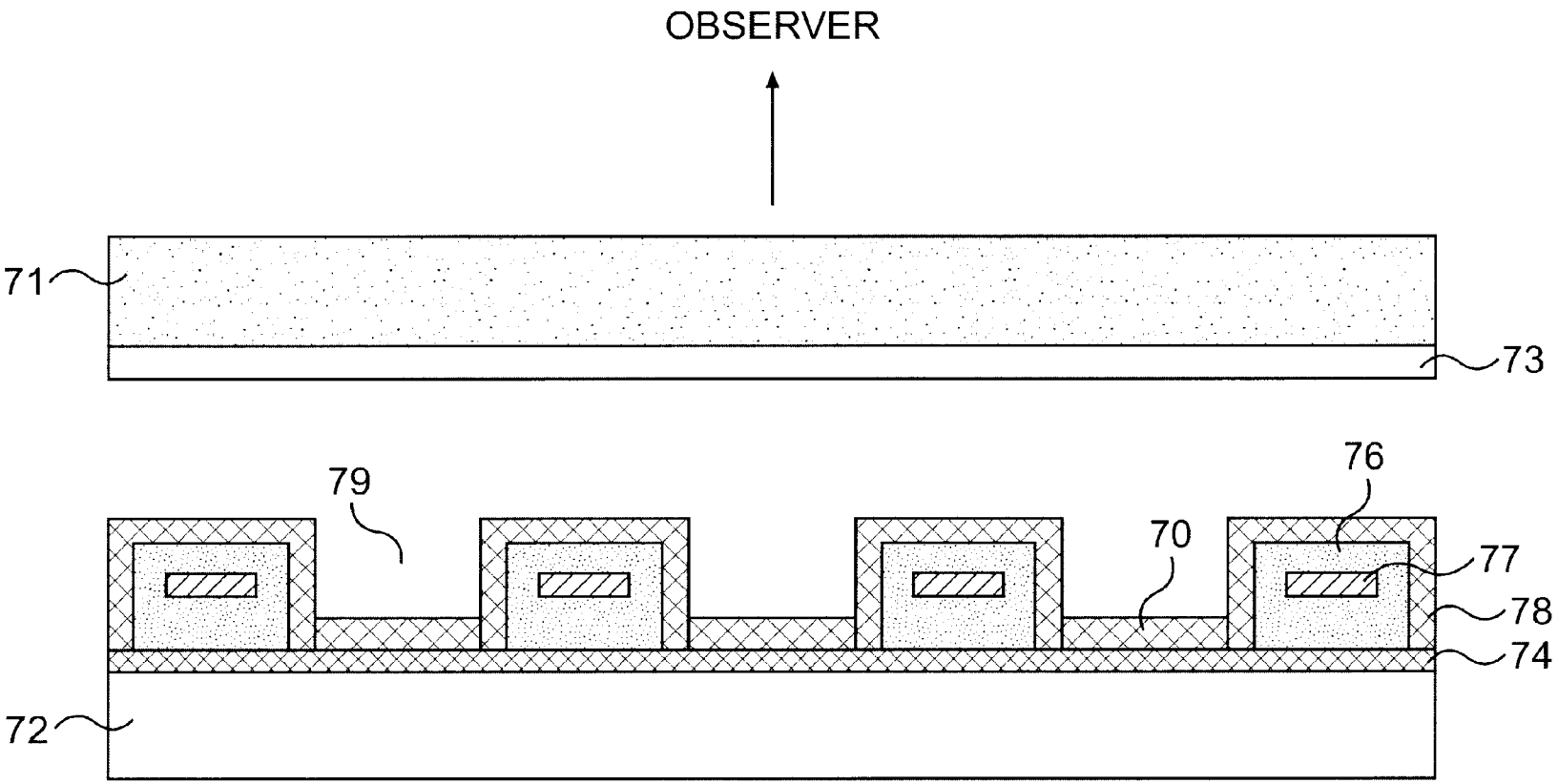
FIG. 7B is a cross-sectional view of the plasma display panel along with the line of VII–VII' of FIG. 5A according to a sixth embodiment of the present invention.

FIG. 7B is a combined cross-sectional view of the plasma display panel according to a sixth embodiment of the present invention. As shown in FIG. 7B, a PDP of the sixth embodiment has a similar structure as that of the fourth embodiment illustrated in FIG. 7A, except for that a second dielectric layer 70, such as a magnesium fluoride ($MgF_2$) layer 70, is formed on the exposed portion of a reflection layer 74 (preferably, formed of aluminum) in the trench discharge space 79. The UV generated in the discharge spaces can penetrate the magnesium fluoride layer 70. The magnesium fluoride ($MgF_2$) layer 70 acts as a protection layer, so that the reflection layer 74 is protected from ion bombardments.

FIG. 8 illustrates a combined cross-sectional view of the PDP according to the fourth embodiment of the present invention along with the line VIII–VIII' of FIGS. 5A and 6. Initially referring to FIG. 8, a reflection layer 54 is formed on a rear substrate 52. A first dielectric layer 56 is formed on the reflection layer 54. A plurality of second electrodes 57 as sustain electrodes are formed in the first dielectric layer 56. The second electrodes 57 are completely buried in the first dielectric layer 56. A second dielectric layer 58, such as a magnesium oxide (MgO) layer, is formed on the first dielectric layer 56.

Figure 5B:
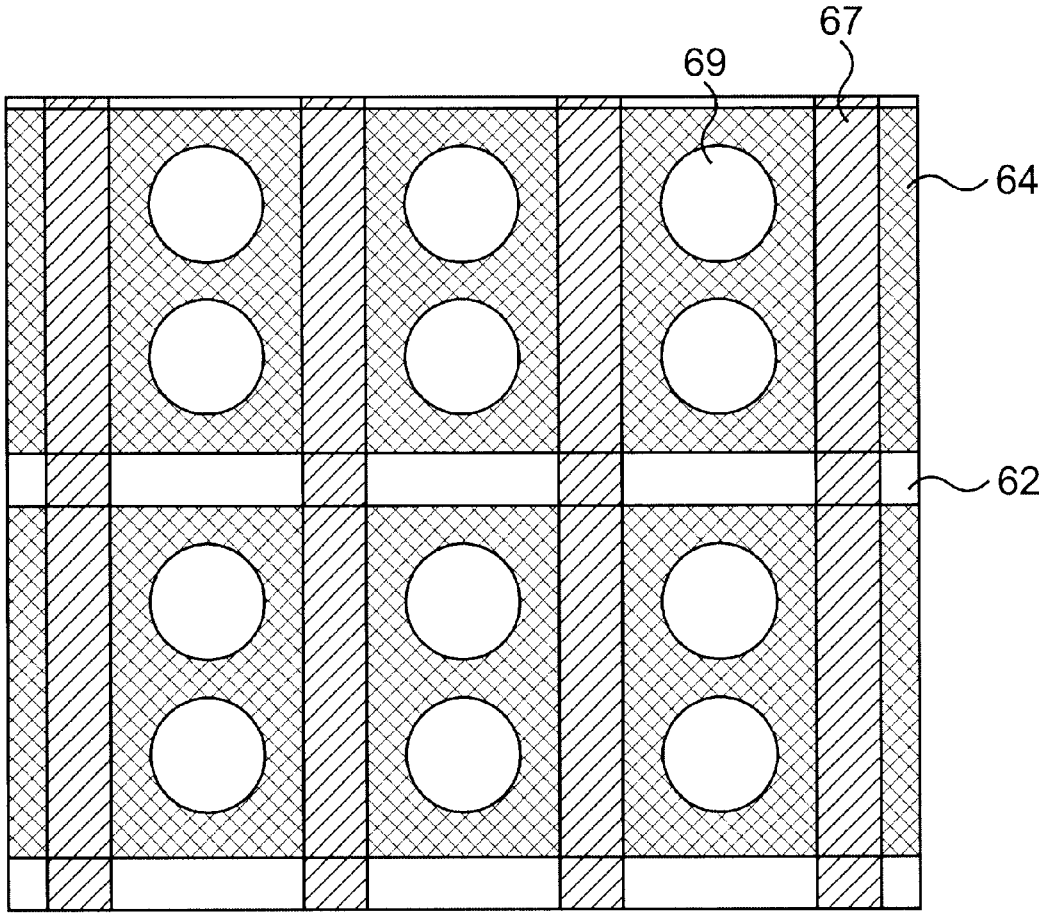
FIG. 5B is a top view of a rear substrate of the plasma display panel according to a fifth embodiment of the present invention.
Figure 5C:
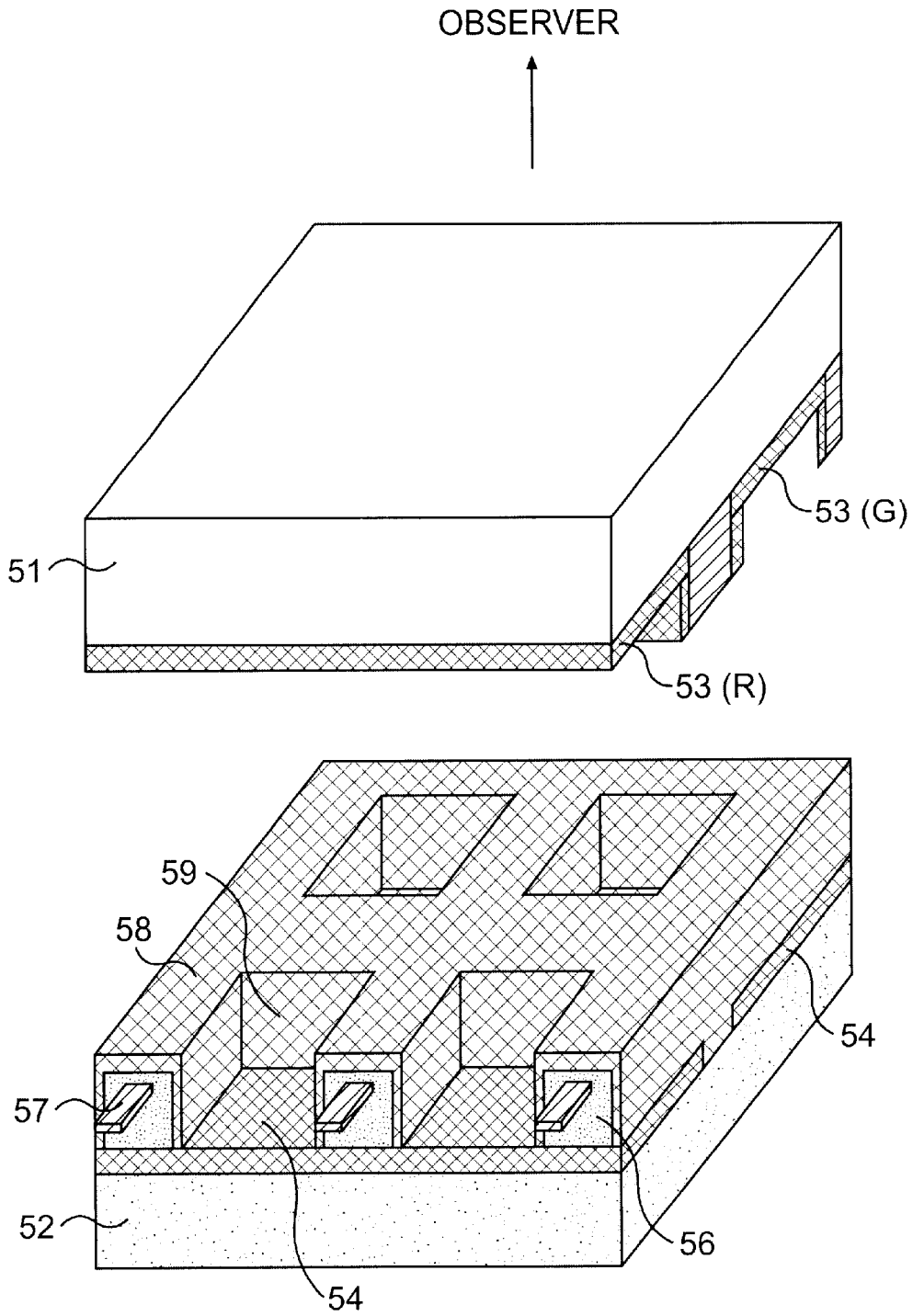
FIG. 5C is a combined perspective view of front and rear substrates of the plasma display panel according to the fourth embodiment of the present invention.

FIG. 5B illustrates a top view of a PDP according to a fifth embodiment of the present invention. A PDP of the fifth embodiment has a similar structure as that of the fourth embodiment, except for that the trench type discharge space has a cylindrical shape. Also, more than one cylindrical type discharge space may be formed in each pixel. In this embodiment, the trench type discharge space has a diameter of 80 to 150 $\mu$m.

In FIG. 6, a top view of the front substrate acting as a viewing panel is schematically illustrated as a preferred embodiment of the present invention. To convert UV to visible light, a UV visible photon conversion 53R, 53G, and 53B such as phosphor layers for generating red, green, and blue are formed on the rear substrate. A barrier rib 110 isolates each of the phosphor layers 53R, 53G, and 53B, as shown in FIG. 6. In the present invention, an operation voltage for the PDP is in the range of 100 to 300 V in AC.

A method of fabricating a reflective type plasma display panel device according to the present invention is now explained. One of the methods for fabricating a plasma display panel device of the present invention is described with reference to FIGS. 9A to 9F.

Figure 9A:
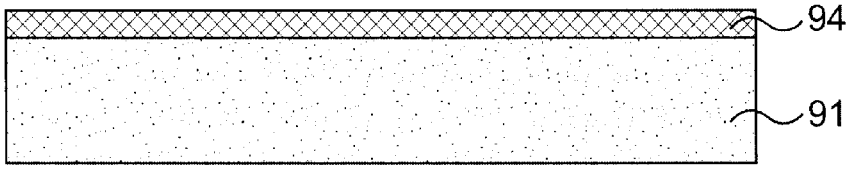
FIGS. 9A to 9F are schematic views illustrating the steps of fabricating the plasma display panel device according to the present invention.
Figure 9B:
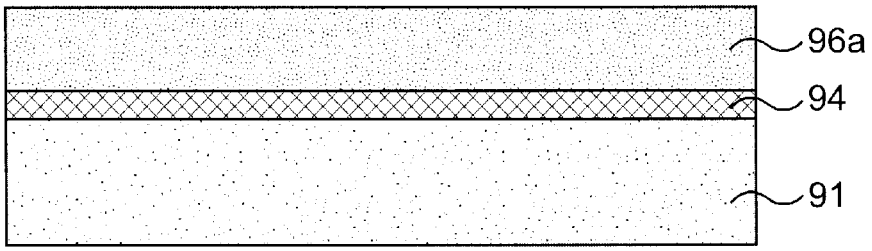
Figure 9C:
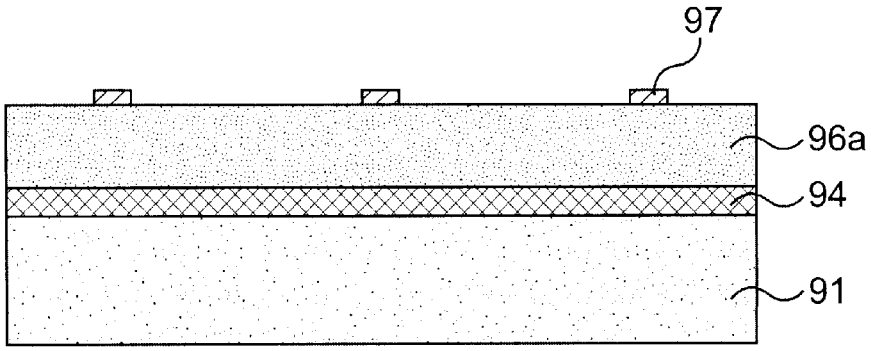
Figure 9D:
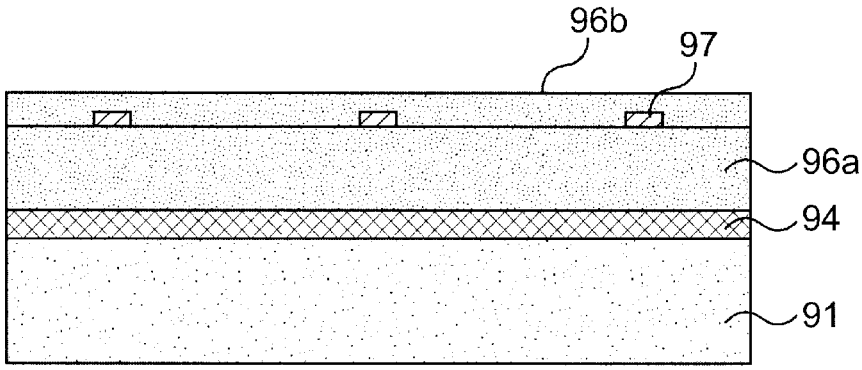
Figure 9E:
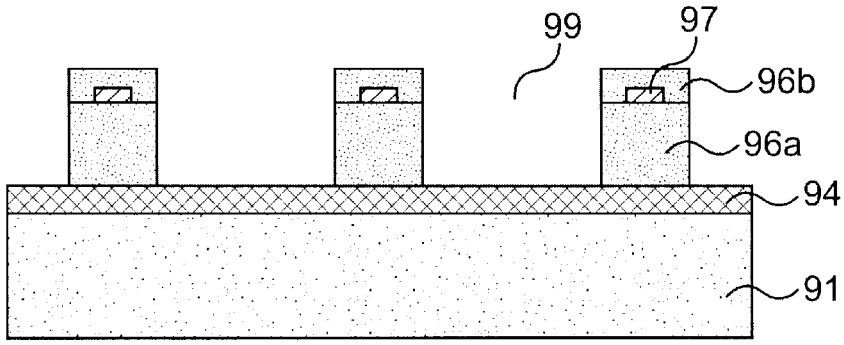
Figure 9F:
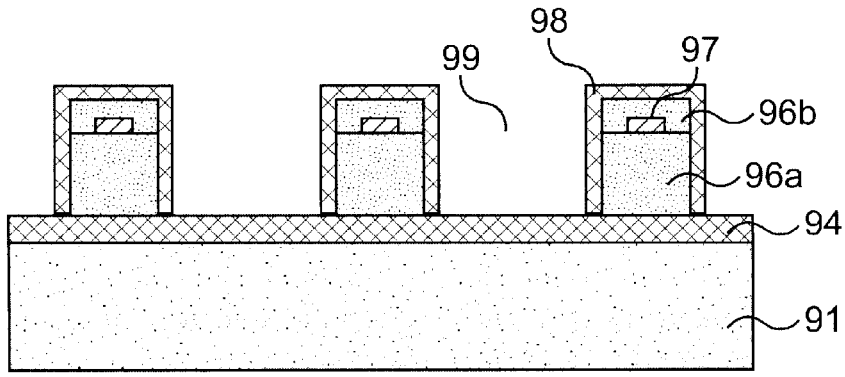
Figure 10:
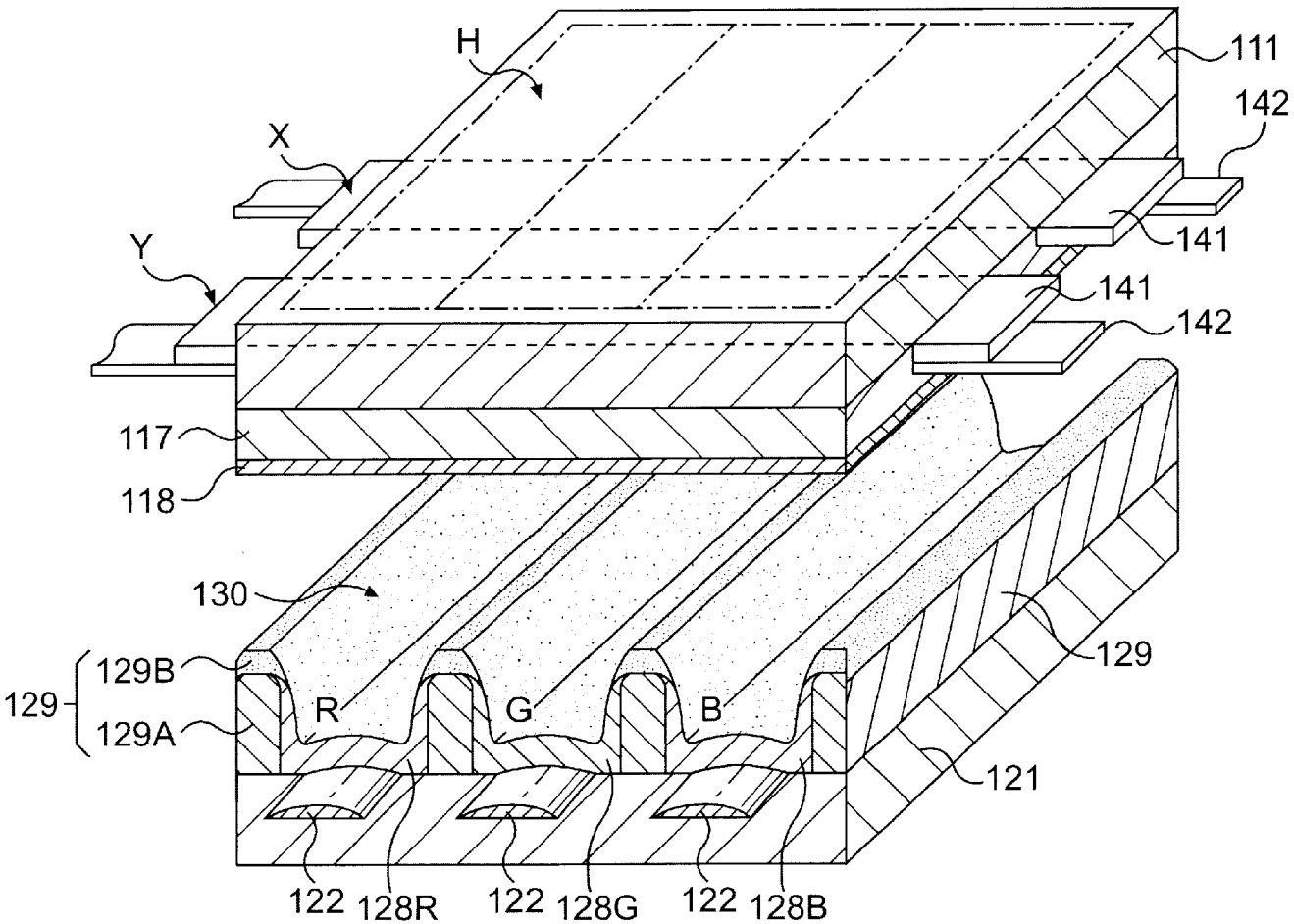
FIG. 10 PRIOR ART
FIG. 10 is a perspective view of the conventional AC barrier type plasma display panel.

As shown in FIG. 9A, a first electrode 94 formed of ITO (indium tin oxide) is formed on a front glass substrate 91. Successively, as shown in FIG. 9B, a first transparent dielectric layer 96*a* (for example, lead oxide (PbO) glass) is formed on the first electrode 94. Then, a plurality of electrodes 97, formed of silver (Ag), are formed on the first transparent dielectric layer 96*a*, as sustain electrodes in FIG. 9C. As shown in FIG. 9D, a second transparent dielectric layer 96*b* is formed on the first dielectric layer 96*a* including the plurality of electrodes 97. A trench discharge space 99 is formed in the first and second dielectric layers 96*a* and 96*b* between the plurality of electrodes 97, thereby exposing the first electrode 94 to a discharge chamber 99 in FIG. 9E. Laser machining or dry/wet etching may be used in forming the trench discharge space 99. Thereafter, a layer of MgO 98 is formed to completely cover the first and second dielectric layers 96*a* and 96*b*, as shown in FIG. 9F.

A plasma display panel of the present invention has the following advantages.

Since the trench type discharge spaces provide a localized electric field by applying DC voltage on the electrode at the bottom of the trench discharge space, a discharge having a high electric field is maintained in the trench discharge spaces, thereby decreasing the sustain voltage. Thus, improved plasma density is obtained in the present invention.

Further, unlike the conventional AC barrier type PDP, a response time is very short because a time for dielectric charging is eliminated from the response time.

It will be apparent to those skilled in the art that various modifications and variations can be made in a plasma display panel device and method of fabricating the same of the present invention without departing from the spirit or scope of the invention. Thus, it is intended that the present invention covers the modifications and variations of this invention provided they come within the scope of the appended claims and their equivalents.

What is claimed is:

1. A plasma display panel having first and second substrates, comprising:

a first electrode on the first substrate;

a first dielectric layer on the first substrate including the first electrode;

a plurality of second electrodes completely buried in the first dielectric layer;

a second dielectric layer on the first dielectric layer including the first electrode;

a third dielectric layer on the second substrate;

a plurality of UV visible photon conversion layers on the third dielectric layer;

a plurality of barrier ribs between each of the UV visible photon conversion layers and connecting the first and second substrates; and a discharge chamber between the first and second substrates defined by the barrier ribs, wherein the first dielectric layer includes at least one trench type discharge space exposing a portion of the first electrode to the discharge chamber.

2. The plasma display panel according to claim 1, wherein the second dielectric layer is formed of magnesium oxide.

3. The plasma display panel according to claim 1, wherein the exposed portion of the first electrode in the trench type discharge space is completely coated with the second dielectric layer.

4. The plasma display panel according to claim 1, wherein the first electrode acts as an address electrode.

5. The plasma display panel according to claim 1, wherein the first electrode is formed of indium tin oxide.

6. The plasma display panel according to claim 1, wherein the trench type discharge space has a dimension of 80 to 150 $\mu$m×240 $\mu$m.

7. The plasma display panel according to claim 1, wherein the trench type discharge space includes a cylindrical type discharge space.

8. The plasma display panel according to claim 7, wherein the cylindrical type discharge space has a diameter in the range of 80 to 150 $\mu$m.

9. The plasma display panel according to claim 1, wherein the second electrodes act as sustain electrodes.

10. The plasma display panel according to claim 1, wherein the first substrate is a viewing panel.

11. The plasma display panel according to claim 1, wherein the UV visible photon conversion layers are formed of phosphor.

12. The plasma display panel according to claim 1, further comprising a third electrode between each of the trench type discharge spaces, the third electrode being substantially parallel to the barrier ribs.

13. The plasma display panel according to claim 12, wherein the third electrode acts as a bus electrode.

14. The plasma display panel according to claim 13, wherein the third electrode is formed of silver.

15. The plasma display panel according to claim 1, wherein the first dielectric layer is formed of lead oxide.

16. The plasma display according to claim 1, wherein the third dielectric layer is formed of a white dielectric layer.

17. The plasma display panel according to claim 1, wherein the panel is operated by an AC voltage in the range of 100 to 300 V.

18. A plasma display panel having first and second substrates, comprising:

a plurality of UV visible photon conversion layers on the first substrate;

a plurality of barrier ribs between each of the UV visible photon conversion layers;

a first electrode on the second substrate;

a first dielectric layer on the second substrate including the first electrode;

a plurality of second electrodes completely buried in the first dielectric layer;

a second dielectric layer on the first dielectric layer; and a discharge chamber between the first and second substrates defined by the barrier ribs connecting the first and second substrates, wherein the first dielectric layer has at least one trench type discharge space exposing a portion of the first electrode to the discharge chamber.

19. The plasma display panel according to claim 18, wherein the first electrode reflects UV light to a direction of the first substrate.

20. The plasma display panel according to claim 18, wherein the first electrode is formed of aluminum.

21. The plasma display panel according to claim 18, wherein the second dielectric layer is formed of magnesium fluoride.

22. The plasma display panel according to claim 18, wherein the first dielectric layer is formed of lead oxide.

23. The plasma display panel according to claim 18, wherein the exposed portion of the first electrode is completely coated with the second dielectric layer.

24. The plasma display panel according to claim 18, wherein the trench type discharge space has a dimension of 80 to 150 $\mu$m×240 am.

25. The plasma display panel according to claim 18, wherein the trench type discharge space includes a cylindrical type discharge space.

26. The plasma display panel according to claim 25, wherein the cylindrical type discharge space has a diameter in the range of 80 to 150 $\mu$m.

27. The plasma display panel according to claim 18, wherein the first substrate a viewing panel.

28. The plasma display panel according to claim 18, wherein the UV visible photon conversion layers are formed of phosphor.

29. The plasma display panel according to claim 18, wherein the second electrodes act as sustain electrodes.

30. The plasma display panel according to claim 18, wherein the panel is operated by an AC voltage in the range of 100 to 300 V.

31. A method of fabricating a plasma display panel having first and second substrates, the method comprising the steps of:

forming a first electrode on the first substrate;

forming a first dielectric layer on the first substrate including the first electrode;

forming a plurality of second electrodes in the first dielectric layer, the second electrodes being completely buried in the first dielectric layer;

forming a second dielectric layer on the first dielectric layer including the second electrodes;

forming a reflection layer on the second substrate;

forming a UV visible photon conversion layer on the reflection layer;

forming at least one trench type discharge space in the first and second dielectric layers exposing a portion of the first electrode in the trench type discharge space to the UV visible photon conversion layer; and forming a plurality of barrier ribs connecting the first and second substrates, thereby defining a discharge chamber between the first and second substrates.

32. The method according to claim 31, wherein the reflection layer includes a white dielectric layer.

33. The method according to claim 31, further comprising the step of forming a bus electrode on the first electrode after the step of forming a first electrode.

34. The method according to claim 31, wherein the first electrode is formed of indium tin oxide.

35. The method according to claim 31, wherein the step of forming at least one trench type discharge space in the first and second dielectric layers includes laser machining or etching.

36. The method according to claim 31, wherein the trench type discharge space has a dimension of 80 to 150 $\mu$m×240 $\mu$m.

37. A method of fabricating a plasma display panel having first and second substrates, the method comprising the steps of:

forming a UV visible photon conversion layer on the first substrate;

forming a first electrode on the second substrate;

forming a first dielectric layer on the second substrate including the first electrode;

forming a plurality of second electrodes on the first dielectric layer;

forming a second dielectric layer on the first dielectric layer including the second electrodes;

forming at least one trench type discharge space in the first and second dielectric layers exposing a portion of the first electrode in the trench type discharge space to the UV visible conversion layer; and forming a plurality of barrier ribs connecting the first and second substrates, thereby defining a discharge chamber between the first and second substrates.

38. The method according to claim 37, wherein the step of forming at least one trench type discharge space in the first and second dielectric layers includes laser machining or etching.

39. The method according to claim 37, wherein the second dielectric layer is formed of magnesium fluoride.

40. The method according to claim 37, wherein the first dielectric layer is formed of lead oxide.

41. The method according to claim 37, wherein the first electrode is formed of aluminum.

42. The method according to claim 37, wherein the trench type discharge space has a dimension of 80 to 150 $\mu$m×240 $\mu$m.

* * * * *